United States Patent [19]

Wadensten

[11] Patent Number: 4,653,927

[45] Date of Patent: Mar. 31, 1987

[54] ROTARY AIR ROLLER VIBRATOR

[76] Inventor: Theodore S. Wadensten, P.O. Box 8, Stilson Rd., Wyoming, R.I. 02898

[21] Appl. No.: 747,180

[22] Filed: Jun. 21, 1985

[51] Int. Cl.[4] ..... B01F 11/00

[52] U.S. Cl. ..... 366/125; 366/600

[58] Field of Search ..... 366/101, 116, 124–126, 366/600; 415/54, 503

[56] References Cited

U.S. PATENT DOCUMENTS

| | | | |
|---|---|---|---|
| 3,162,426 | 12/1964 | Fontaine | 366/125 X |
| 3,376,021 | 4/1968 | Fontaine | 366/125 |
| 3,672,639 | 6/1972 | Wadensten | 366/125 |
| 3,790,137 | 2/1974 | Wadensten | 366/125 |
| 4,300,843 | 11/1981 | Halilovic et al. | 366/125 |

*Primary Examiner*—Timothy F. Simone
*Attorney, Agent, or Firm*—Ralph R. Roberts

[57] ABSTRACT

A rotary air roller vibrator is depicted in which a housing has a cylindrical bore closed by two inner end plates which form a chamber. An axial shaft is fixed between these end plates and has a longitudinally disposed slot within which is slideably mounted a vane having a plurality of formed side-opening slots that are opened when the vane is lifted under the influence of pressurized air. A cylindrical rotor having an inner diameter greater than the diameter of the shaft is also sized so that the outer diameter is carried on two races pressed into place at the ends of the housing. These races are sized to prevent the rotor from striking the shaft. Each of these end plates has outer exhaust apertures arrayed in a three-quarter circle pattern and in secured position these apertures are aligned. End covers are provided, with one cover providing a cavity for receiving air from the chamber and redirecting this air through the apertures in the plates to a space outside of the moving rotor to provide an air cushion tending to lift the rotor and induce spinning. Pressurized air forces the vane against the rotor and escapes diagonally from the slots to impinge on the rotor to induce spinning and moving the rotor against the races. The escaping air flows through exhaust holes and a conductor in the shaft and into the cavity in the end cover and returns over the outside of the rotating rotor to and through apertures in a front end plate and through exhaust holes in the second cover. The motion of the rotor is continuous and produces vibration forces due to the off-center motion of the rotor.

20 Claims, 17 Drawing Figures

ROTARY AIR ROLLER VIBRATOR

CROSS-REFERENCE TO RELATED PATENTS

To the extent this application is applicable, reference is made to U.S. Pat. No. 3,638,914 (Ser. No. 42,791 of June 2, 1970) and the Continuation-in-Part U.S. Pat. No. 3,672,639, as issued June 27, 1972, to the applicant of the invention.

BACKGROUND OF THE INVENTION

1. Field of the Invention

This invention pertains to rotary vibrations induced by a pneumatically-actuated roller within a housing. This roller is revolved so that heavy-duty vibrations are produced with a reduction of noise levels of less than those found in conventional devices.

2. Description of the Prior Art

Rotary vibrators, and particularly those actuated and/or driven by pneumatic forces, are well known. Rotary vibrators have been used for many years and many include concrete compacting devices such as those to FONTAINE, as exemplified in U.S. Pat. No. 2,763,472, as issued Sept. 18, 1956; U.S. Pat. No. 2,967,048, as issued Jan. 3, 1961; U.S. Pat. No. 3,030,079, as issued Apr. 17, 1962; U.S. Pat. No. 3,162,426, as issued Dec. 22, 1964, and U.S. Pat. No. 3,376,021, as issued Apr. 2, 1968. Also known is United Kingdom Pat. No. 2,010,402, of June 27, 1979, to ESEF HALILOVIC. This same inventor has a U.S. Pat. No. 4,300,843, as issued Nov. 17, 1981. Other U.S. patents of note are U.S. Pat. No. 2,834,584 to BONDESON et al, as issued May 13, 1958; and to BONDESON independently in U.S. Pat. No. 2,956,788, as issued Oct. 18, 1960. Of note is BODINE JR., U.S. Pat. No. 3,191,911, as issued June 29, 1965; BEST, U.S. Pat. No. 3,528,646, as issued Sept. 15, 1970; MATSON, U.S. Pat. No. 3,822,054, as issued July 2, 1974, and FINK, U.S. Pat. No. 3,870,281, as issued Mar. 11, 1975.

The inventor of this apparatus has also been closely associated with vibration equipment and, in addition to the U.S. Pat. Nos. 3,673,639 and 3,790,137 noted above, by assignment of or application has been instrumental in bringing to the marketplace U.S. Pat. No. 3,112,098 to ANDERSON, as issued Nov. 26, 1963, and his U.S. Pat. No. 3,672,639, as issued June 27, 1972. The above devices, when operated at speeds in excess of five thousand R.P.M.'s, produce noise above one hundred decibels on the A-scale and several produce readings in the one hundred ten to one hundred fifteen levels. The apparatus of this invention produces a noise in the acceptable levels of about eighty dB, and with muffler material to seventy to eighty-two dB (dB readings taken at one meter on A-scale).

SUMMARY OF THE INVENTION

This invention may be summarized, at least in part, with reference to its objects. It is an object of this invention to provide, and it does provide, a rotary high-frequency vibrator with drastically reduced noise and wear of components.

It is a further object of this invention to provide, and it does provide, a rotary high-frequency vibrator particularly adapted for use in the concrete precast and prestressed industry and is sufficiently silent to meet acceptable OSHA noise level limits.

It is a still further object of this invention to provide, and it does provide, a novel and improved vibrator which is pneumatically actuated at selected high speeds. This vibrator requires no special valves and is simple in construction and has no striking of the rotor against the fixed shaft by providing a pair of race members that are sized so as to prevent contact of the rotor with the shaft.

It is a still further object of this invention to provide, and it does provide, an improved pneumatic driven vibrator which is easy to fabricate and, if necessary, to repair. This vibrator is quite efficient in operation in that it saves pressurized air and is a single-stage vibrator with only two moving parts and for construction requires no special tools or dies.

This vibrator is contemplated to be compact in its design and is rugged for heavy-duty applications such as shaking a railroad car to speed unloading, move stubborn materials from bins, and is ideal for all concrete which is to be precast or prestressed. This vibratory action assists in settling concrete into forms and these vibrations make such strong and dense and void-free of air.

The concrete industry in particular has for many years, due to OSHA, tried to procure a vibration unit that produces acceptable noise levels. The acceptable level of noise for those workplaces exposed for periods up to eight hours is 85 dB (dB readings taken at one meter on A-scale) and the vibrator of this invention produces such acceptable levels. The vibrator of this invention has high-frequency (9,000 to 12,000) vibrations per minute, and with high force of 5,000 to 8,000 pounds of force or impact. Prior vibration apparatus utilizing rotors which are rotated around a shaft hit the shaft or housing or both, creating a metal-to-metal high-pitched noise. This the present invention does not do.

The vibrator, to be hereinafter more fully shown and described, uses a rotor that rolls or slides on two hardened races secured in the housing. These races are so formed that as the rotor rests and when rotated, there is a small space between the shaft and the inner diameter of the rotor of about one thirty-second of an inch.

These races positively prevent the rotor from hitting the shaft. It is desired that the rotor rotate rather than hit the races. When hitting the shaft, a striking noise is created which may be as much as 110 to 115 dB.

The present invention provides a vibrator where the centrifugal force created is less destructive and has a much reduced level of noise which is at OSHA levels and is simpler in design and construction. This vibrator, as later more fully described, includes a shaft held in place between two apertured inner end plates. Immediately interior of each of these inner end plates is a wear plate made of thin spring steel that a rotor rolls against as it is moved around and in a determined orbit as established by two hardened races which are pressed into position in a housing. The shaft is formed with a slot within which a vane slides up and down. This sliding vane is like and acts as a valve dividing the area between the shaft and rotor so as to provide a high- and low-pressure area. One of the inner end plates has an air inlet where a nipple and hose are secured to carry high-pressure air to the vibrator and the other inner end plate has an exit hole for the exhausting air. A back cover plate has no exit holes and preferably retains muffler material. The front cover plate has an entry hole for the air hose and perforations for the exit of air after powering the vibrator. The vibration unit is held together with bolts or cap screws.

In addition to the above summary, the following disclosure is detailed to insure adequacy and aid in understanding of the invention. The disclosure, however, is not intended to cover each new inventive concept no matter how it may later be disguised by variations in form or additions of further improvements. For this reason, there has been chosen a specific embodiment of pneumatically-actuated roller vibrator as adopted for use for concrete compacting devices and showing a preferred means for constructing and assembling this rotary vibrator. This specific embodiment has been chosen for the purposes of illustration and description as shown in the accompanying drawings wherein:

BRIEF DESCRIPTION OF THE DRAWINGS

In the following description and in the claims, various details are identified by specific names for convenience. These names are intended to be generic in their application. Corresponding reference characters refer to like members throughout the several figures of the drawings.

The drawings accompanying, and forming part of, this specification disclose details of construction for the purpose of explanation, but structural details may be modified without departure from the concept and principles of the invention and the invention may be incorporated in other structural forms than shown.

EMBODIMENT OF FIGS. 1 AND 2

Figure 1:
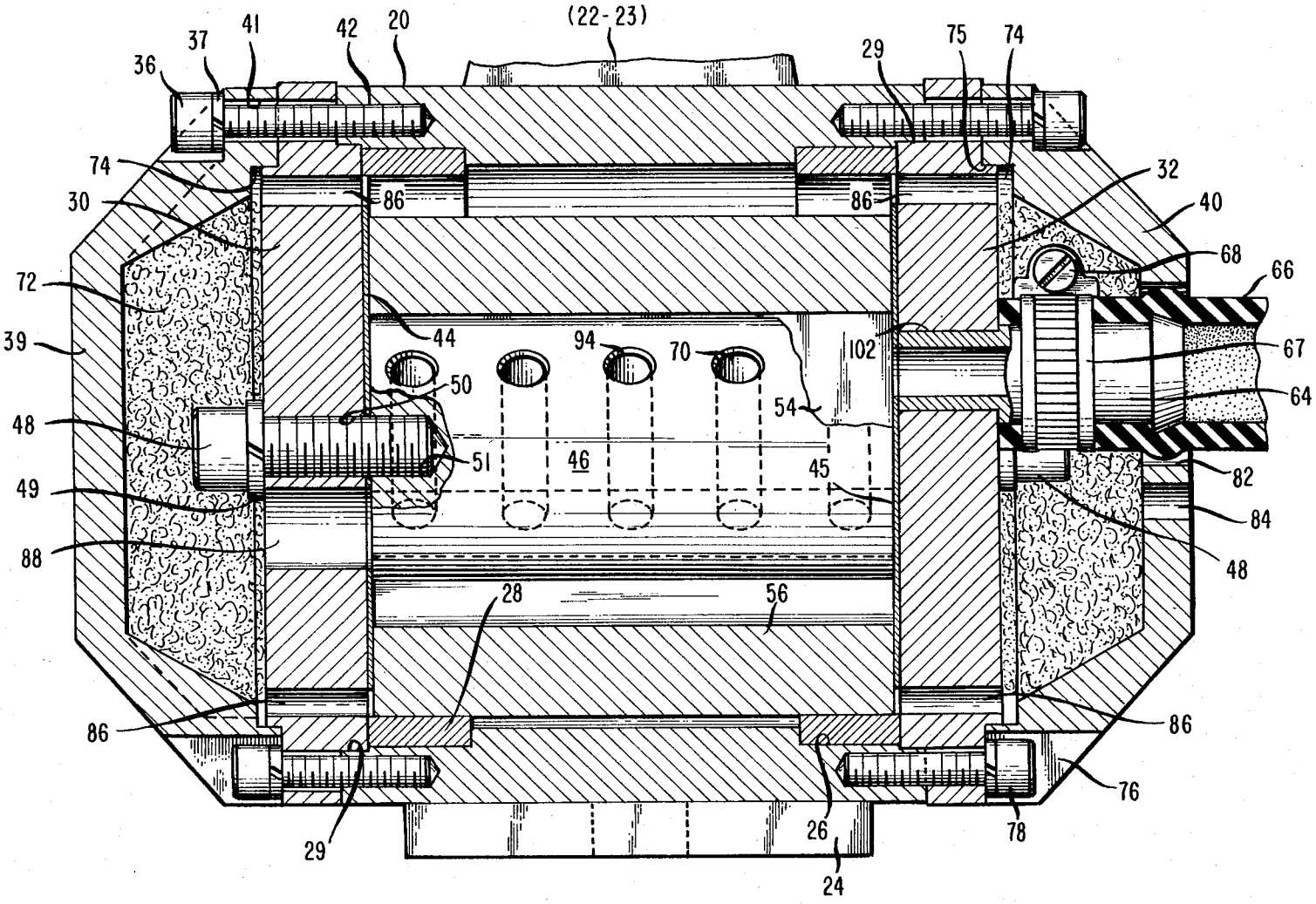
FIG. 1 represents a sectional side view, partly diagrammatic, and showing the relationship of the several components of this rotary air roller vibration apparatus, this view taken on the line 1—1 of FIG. 2 and looking in the direction of the arrows.
Figure 2:
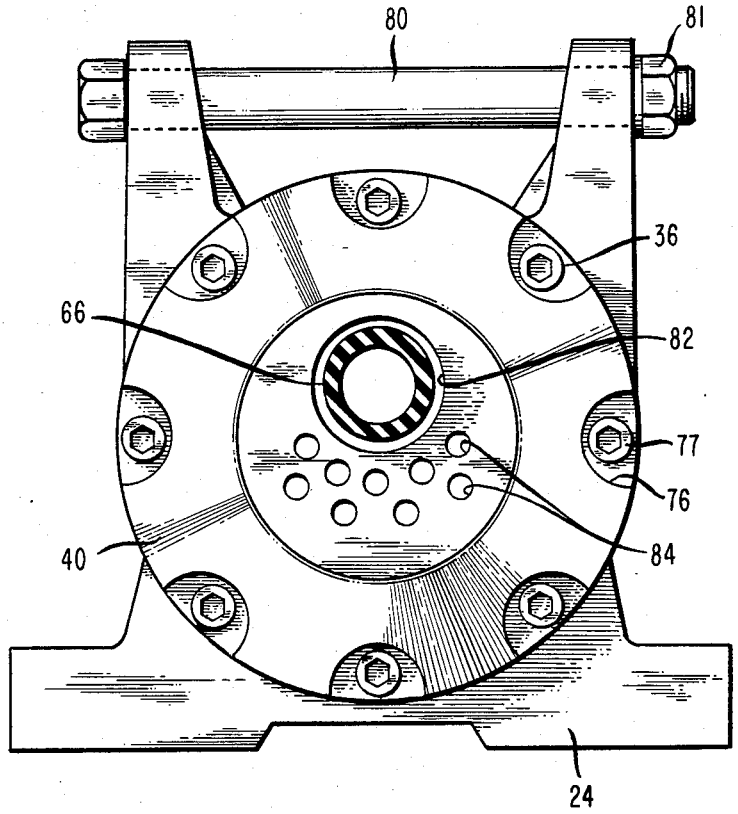
FIG. 2 represents an end view of the vibrator of FIG. 1, this view in a slightly reduced scale and showing the inlet conductor and exhaust holes.

Referring next to the drawings in detail, and particularly to FIGS. 1 and 2, the rotary air roller vibrator is shown in a preferred assembled condition. In FIG. 1, the vibrator is depicted in a sectional side view which is more or less diagrammatic and representative. The rotation is established by the construction of the shaft and the other components, and the length and diameter of the vibration unit is established by the desired force to be created and the desired speed establishes the rotor diameter. As depicted, a housing 20 is of cast steel to provide structural strength. This housing may have ears 22 and 23 and a support base 24, as seen in FIG. 2. This housing is precisely bored at each end to provide counterbores 26 for like races 28. These races are hardened steel and provide precise internal diameters when pressed in place in the counterbores 26. The housing is further formed with like steps 29 to retain and provide positioning means for inner end plates 30 and 32. These end plates have bored holes to accept cap screws or bolts 36 which have lock washers 37 disposed beneath the heads of said cap screws. These same cap screws also retain end cover members 39 and 40 by passing through holes 41 in the covers. These cap screws have their threaded shank portions adapted to enter threaded holes 42 formed in the housing 20.

Figure 3:
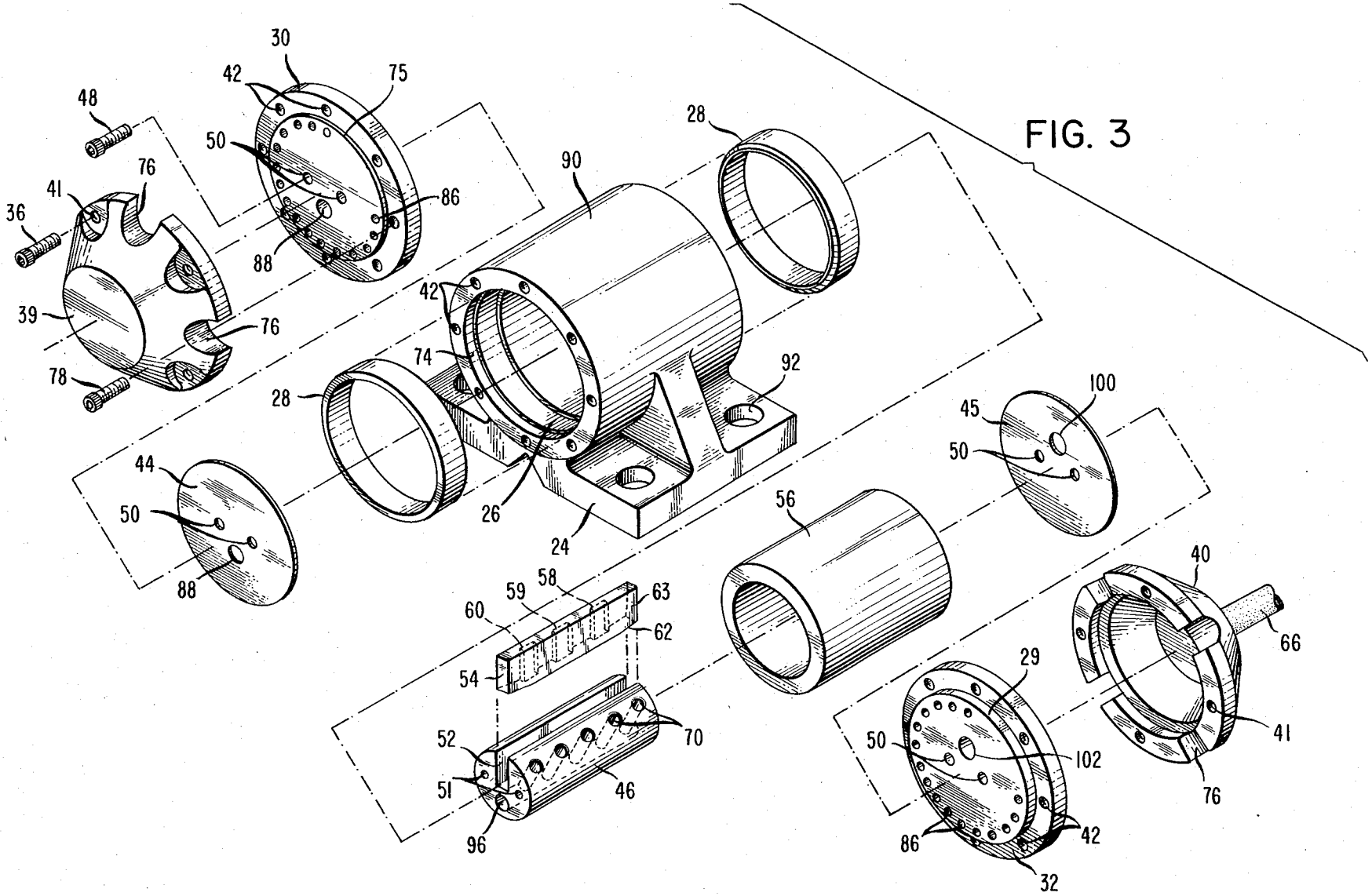
FIG. 3 represents an exploded isometric view of the components of the vibrator of FIG. 1, this view in a reduced scale and partly diagrammatic, and showing wear plates having an absence of through air transfer apertures.

Adjacent the inner end plates 30 and 32 are spring steel wear plates 44 and 45 which are usually about one-sixteenth of an inch in thickness. These wear plates have holes sized and positioned to mate with the holes in the inner end plates 30 and 32. A fixed-in-place shaft 46 is retained at both ends by cap screws 48 and lock washers 49. The threaded shank of these cap screws passes through apertures 50 in the inner end plates 30 and 32 and into threaded blind holes 51 in the shaft 46. This shaft 46 has a longitudinal slot 52 (FIG. 3) in which is mounted a vane 54. This vane is slideable in this slot 52 and is generally rectangular and extends from wear plate 44 to wear plate 45. With each revolution of a tubular roller 56, this vane reciprocates within the slot. The outer end of the vane may be rounded to slide on the inner diameter of the roller 56. This vane is formed with a plurality of air passage slots and, as shown, are three in number, identified as 58, 59 and 60 (FIG. 3). It is to be noted that these air-escape slots terminate at the full width of the vane, with the air exiting at a face portion thereof. The vane at its innermost position utilizes a small bevel 62 from end 63 to the first slot 58 (FIG. 3) and provides insurance that pressurized air entering through nipple 64 engages the bottom of the vane to insure a lifting of the vane. This vane and the slots therein are described in detail hereafter.

Still referring to FIG. 1, it is to be noted that pressurized air is fed and delivered to the vibrator through a flexible conductor 66 which, as shown, is mounted on nipple 64 and is secured thereon by a hose clamp 67 tightened by a screw 68 associated with said hose clamp. The nipple 64 may be secured in end plate 32 by threads, a press fit or by adhesive. The inner end of this nipple is open to the inner portion of the vibrator, with the wear plate 45 having a mating aperture providing means for the pressurized air to pass through said wear plate 45. Seen in this view are a plurality of air exhaust or receiving holes 70 formed and provided in fixed shaft 46. Muffler material 72 is provided in the space between cover 39 and end plate 30 and likewise in the space between cover 40 and end plate 32. Both covers 39 and 40 are machined to provide female recess and shoulder diameters 74 which are sized to position these covers on male shoulder diameters 75 formed on the end plates 30 and 32. It is to be noted that the cap screws 36 are disposed to retain both of the covers 39 and 40 and the adjacent end plates 30 and 32, but the covers 39 and 40 are alternately recessed at 76 to allow shorter cap screws 78 and lock washers 37 to engage and retain the end plates 30 and 32 to the housing. This is a matter of design and preference.

Referring now in particular to FIG. 2, it is to be noted that between ears 22 and 23 of the housing 20 there is mounted a handle portion 80 which may be a stud which is threaded at both ends. Secured on each threaded end is a nut 81. An aperture 82 is formed in cover 40 and below this aperture is a multiplicity of vent holes 84 which are formed in this cover member 40 and provide escape or vent means for passage of the air after the energy used to drive the rotor has been used.

EMBODIMENT OF FIG. 3

In FIG. 3 there is shown the vibrator apparatus in an exploded condition. The rear cover 39 is shown as retained by cap screws 36, with the recesses 76 disposed ninety degrees therefrom. Cap screws 78 are used to retain end plate 30 to the housing 20. Immediately to the right of cover 39 is end plate 30 with male shoulder 75 visible. A through hole 42 is provided for each cap screw 36 and 78. The end plate 30 is formed with a plurality of through apertures 86. These apertures are precisely formed in only three-quarters of a circle pattern, with one-fourth of the end plate void of exhaust apertures 86. Also seen in this view is an air passage hole 88 and on the axis line there are the two apertures 50, each sized for the passing therethrough of a cap screw 48.

Adjacent to end plate 30 is wear plate 44. As depicted, this wear plate is made with an outer diameter that is just short of the inner diameter of the ring of holes 86. This wear plate 44 is also provided with through holes 50 for the passing therethrough of the threaded shank of cap screws 48. This plate is also provided with air passage hole 88 that in mounted condition is in coincidence with hole 88 in plate 30. Immediately to the right of this plate is hardened steel race 28 which is pressed into a retained position in housing 20.

Figure 7:
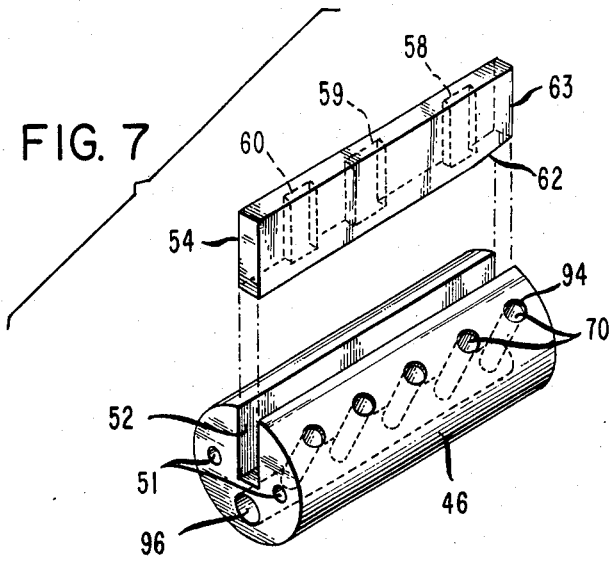
FIG. 7 represents an isometric view, partly diagrammatic, and illustrating in a slightly exaggerated condition the spacing of the vent slots and the exhaust holes in the shaft and the vane movable in a slot in the shaft.
Figure 8A:
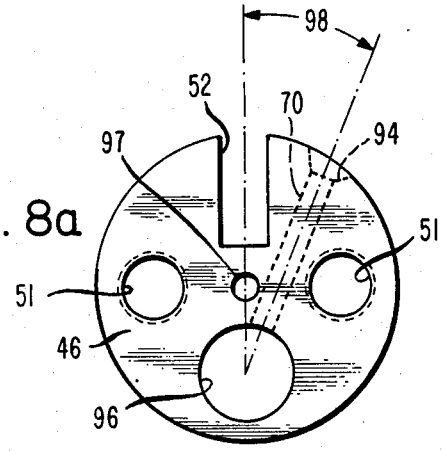
FIG. 8A represents an end view of the fixed-in-place shaft, this view showing the relationship of the vane slot, the exhaust holes and the longitudinal drilled air exhaust hole.

In FIG. 3 a housing 90 is like housing 20 of FIGS. 1 and 2, but, as shown, is without ears. This housing in other respects is like that of FIG. 1 and shows threaded holes 42 and a counterbore 26 into which is pressed race 28. The female recess shoulder 74 provides a seating bore for end plate 30. This housing 90 is shown with a base 24 into which are formed mounting bolt holes 92. Another race 28 to the right of this housing is like the race that is mounted in the left end of housing 90 and is also pressed into a counterbore as in FIG. 1. To the right of race 28 and on the next exploded assembly line is fixed-in-place shaft 46. This shaft and vane are shown in greater detail in the isometric showing of FIG. 7 and the end view of FIG. 8A. The vane 54 is shown in greater detail in FIGS. 8B and 8C. This shaft 46, as seen in FIGS. 3, 7 and 8A, is made of steel and in both ends are formed threaded holes 51 for the receiving and retaining of cap screws 48. As depicted, shaft 46 has five like sized and positioned exhaust holes 70.

As seen in FIG. 8A, the exit ends of these exhaust holes are beveled at 94 so as to reduce any input whistle of entering air. These exhaust holes terminate at a through drilled hole 96 which is in alignment with and in communication with air passage hole 88 in end plate 30. As seen in FIG. 8A, a construction hole 97 is formed in each end to assist in the precise forming of the diameter and length. This construction hole is used only for an assist in machining this shaft and is not used in the operation of the shaft 46.

Figure 8B:
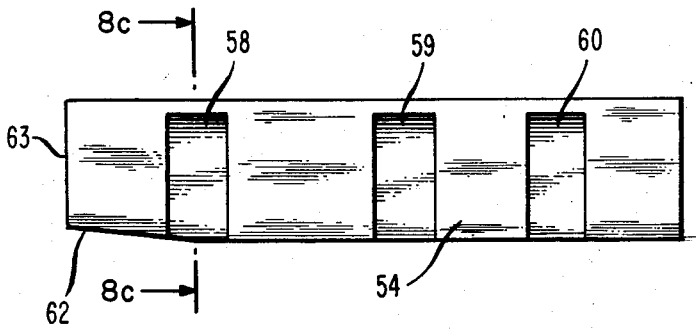
FIG. 8B represents a face view of a vane and showing this spaced relationship and beveled lower surface.
Figure 8C:
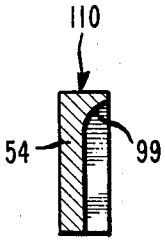
FIG. 8C represents a sectional view of a vane slot, this sectional view taken on the line 8C—8C of FIG. 8B and looking in the direction of the arrows.
Figure 11:
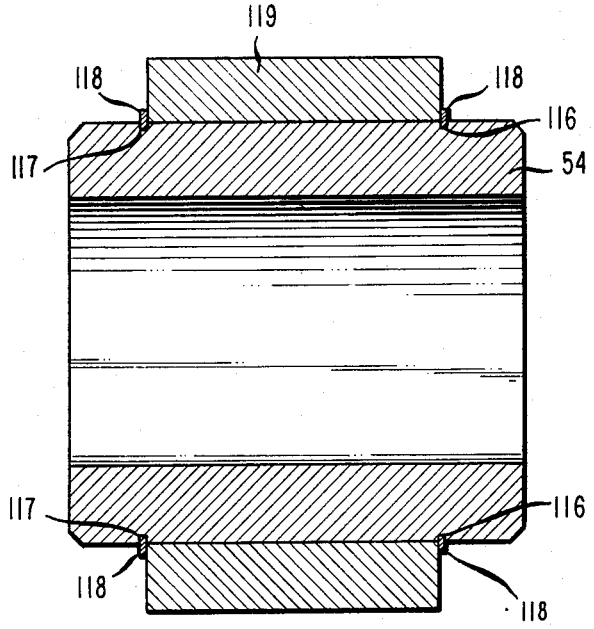
FIG. 11 represents a sectional view of an alternate construction of a rotor with an added tubular member added to provide added vibrational force.

In constructing the shaft 46 (FIG. 8A) it is to be noted that angle 98 is precisely ascertained in relation to the slot 52 so that the number and action of these holes have a very precise relationship to the efficiency and rolling action of the rotor 56. This angle 98 has been determined to be about twenty-two degrees from the theoretical axis line passing through the center of slot 52. The vane 54 is preferably made of plastic to reduce wear on the inner diameter of the roller 56. As seen in FIGS. 8B and 8C, the air passage slots 58, 59 and 60 are formed in the side of this vane member 54. It is to be noted particularly in FIG. 8C that each of the exit ends of these slots is formed with a radius 99 short of the full width top of the vane. It is also to be noted that from end 63 to about the inner end of slot 58, the bottom extent of this sliding vane is angled upward at 62 to provide an air lifting action when air is fed in and through nipple 64.

To the right of the shaft 46 (FIG. 3) is depicted the roller 56 which is precisely formed with an inner and outer diameter as well as a precise length to fit within wear plates 44 and 45. The wear plate 45 has two mounting holes 50 for cap screws 48 and also an aperture 100 for the passage therethrough of pressurized air as it exists from the nipple 64 into the interior chamber.

On the next lower alignment is end plate 32. This end plate is provided with mounting holes 50 for the passage therethrough of cap screws 48. These holes precisely position the holes 86 to be arranged as those formed in end plate 30. The same quadrant void of holes is duplicated in this plate. An aperture 102 is formed to accept and retain the reduced end or shank of nipple 64 as described above. The shoulder 29 provides the desired alignment of the end plate 32 to the housing 20 or 90.

As depicted, a cover 40 is similar to cover 40 as described in conjunction with FIG. 2 and is provided with an aperture 82 for the easy passage therethrough of the hose conduit 66.

FLOW DIAGRAM OF FIG. 4

Figure 4:
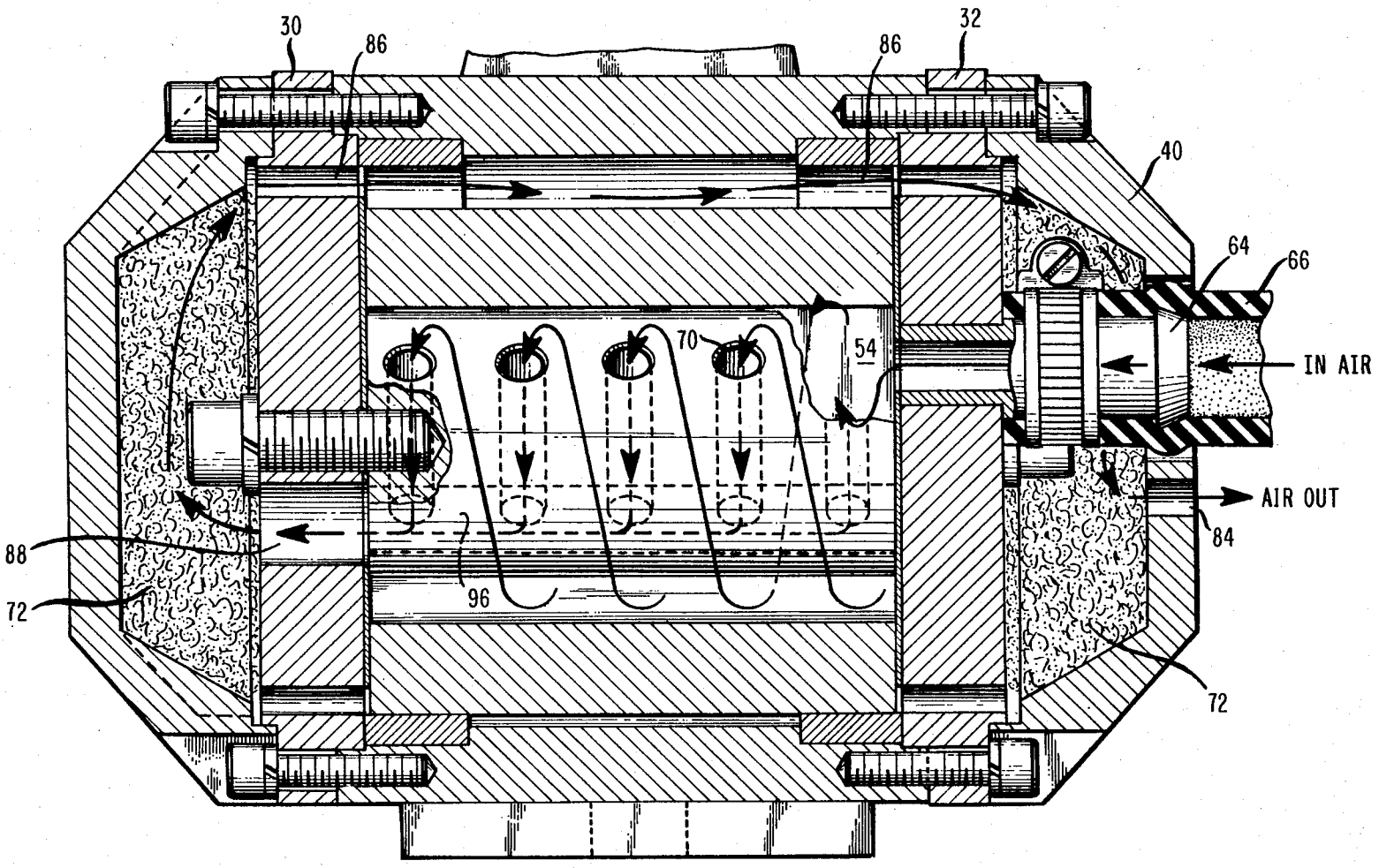
FIG. 4 represents the sectional side view of FIG. 1, but showing the flow path of pressurized air as it enters the apparatus, is used and finally exhausted from the apparatus.

In FIG. 4, the sectional view of FIG. 1 is repeated to illustrate the flow of pressurized air in and through hose 66, nipple 64 and lifting vane 54. As seen more particularly in FIGS. 10A, 10B and 10C, this air flows from the air passage slots to cause roller 56 to rotate. The now-expanded air flows around shaft 46 and into exhaust holes 70 through passageways 96 and 88 to and through the muffler material 72, thence through the ring of holes 86 in end cover 30, through the space between the roller and the inner bore of the housing 20, thence through ring of holes 86 in end cover 32, then through that muffler material 72 in the cover 40 and then as exhaust air through vent holes 84.

COVER AS IN FIG. 5

Figure 5:
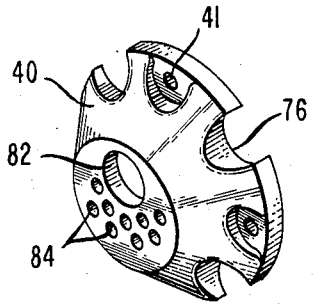
FIG. 5 represents an isometric view, partly diagrammatic, of a cover plate as shown in FIGS. 2 and 3, but for illustrative purposes is turned one hundred eighty degrees so as to show a conductor inlet and exhaust holes provided in the cover.

In FIG. 5, the end cover 40 of FIGS. 1, 2 and 3 is shown in a perspective view and, to illustrate the inlet and exhaust holes formed therein, this view has the cover turned one hundred eighty degrees for the purpose of description. This cover is like cover 39, but with an aperture 82 formed therein for the easy passage therethrough of a conductor 66. As shown, there are nine (but could be more or fewer) exhaust holes 84 in the outer flat central portion of the cover. This cover has alternate cutouts 76 for bolts 78 and pockets with bolt holes 41 for cap screws 36.

ALTERNATE WEAR PLATES AS IN FIGS. 6A AND 6B

It is also contemplated that the wear plates 44 and 45 as shown in FIGS. 1 and 3 may be made larger in diameter to extend to the outer diameter of the face of the races 28. If such wear plates are contemplated, these plates must be provided with the same pattern of air passage holes to match the three-quarters quadrant pattern of holes 86 provided in end plates 30 and 32. Wear plate 144 in FIG. 6A has a pair of through holes 50 and also an air passage hole 88 as in plate 44. Apertures 106 are provided and formed in the outer peripheral portion of plate 144 and are of a size and spacing to mate with holes 86 in end plate 30. In mounted and secured condition, the cap screws 48 retain this wear plate in fixed orientation with shaft 46. In a like manner, a wear plate 145 is formed with two mounting holes 50 and an inlet aperture 100 which is coincident with the nipple 64 exit. This wear plate 145 has a like outer diameter to conform to wear plate 144. In this outer peripheral portion are aperture 108 which are of the same size and position to the three-quarters quadrant of holes 86 formed in end plate 32.

EMBODIMENT OF FIGS. 7, 8A, 8B AND 8C

In FIG. 7, the showing of the vane 54 and shaft 46 is repeated to more clearly illustrate the necessary relationship of the sliding vane in the slot 52 of the shaft. As seen, there are five exhaust holes 70 formed and provided in shaft 46. These holes are equally sized and spaced and are about three-eighths of an inch in from each end of the shaft and these holes are about five-eighths of an inch apart on centers. It is to be noted that these exhaust holes terminate at the longitudinal hole 96. Also shown are the two mounting threaded holes 51 provided in each end of this shaft. The vane 54 is slideable in the slot 52 in the shaft. This vane is more completely shown in FIGS. 8B and 8C. In FIG. 8A is provided a detailed end view of shaft 46 and the chamfer 94 at the entrance end of holes 70.

In FIGS. 8B and 8C, the vane 54 is preferably made of a very durable plastic such as Delrin (TM DuPont) (polyformaldehyde), a thermoplastic acetal resin. The vane is formed as a generally rectangular member having three air passage slots 58, 59 and 60. Slot 58 is the slot nearest to the nozzle outlet in end plate 32. At this slot and at the bottom of this vane is formed the slope or bevel 62 which is at about five degrees to the bottom surface. The depth of these slots is about half the thickness of the vane, which is about five-sixteenths of an inch. The radius 99 depicted terminates about a sixteenth of an inch from top surface 110.

Vane 54 is depicted as having three locally-formed slots 58, 59 and 60, with the opening from the bottom of the vane to the curved end 99. The top portion 110, like the rest of the vane, is full width of the vane. This vane is reciprocated in slot 52 as the rotor 56 is rotated. It is necessary that the vane be lifted by an equal amount or pressure of air whereat the slots are positioned at other than equal distances from each other. With the vane at its innermost position, the upper end of the slots is closed by top surface or end 110. As the rotor is moved, the vane is urged outwardly and the slots become more exposed. The spacing of the slots from end 63 is made greater so that as they come into use, the slot farthest from the discharge end of the nipple 64 is spaced closer together to balance the lifting forces on the vane 54. This spacing of the slots insures that the vane moves up in a straight line and is not jammed against the wear plates during its movement. Assuming the vane is about four inches in length, the center of slot 58 is about one inch from the right end. Slot 59 is about one and three-eighths inches farther and slot 60 is about one inch still farther. The slots are contemplated to be about three-eighths of an inch in width. It is to be noted that FIG. 8B is looking *toward* the cutouts 58, 59 and 60, and the view of FIG. 8C is taken on the line 8C—8C thereof. In practice, slot 58 is nearest the nozzle exit end of and opening 102 in end plate 32.

ALIGNMENT OF FIG. 9

Figure 9:
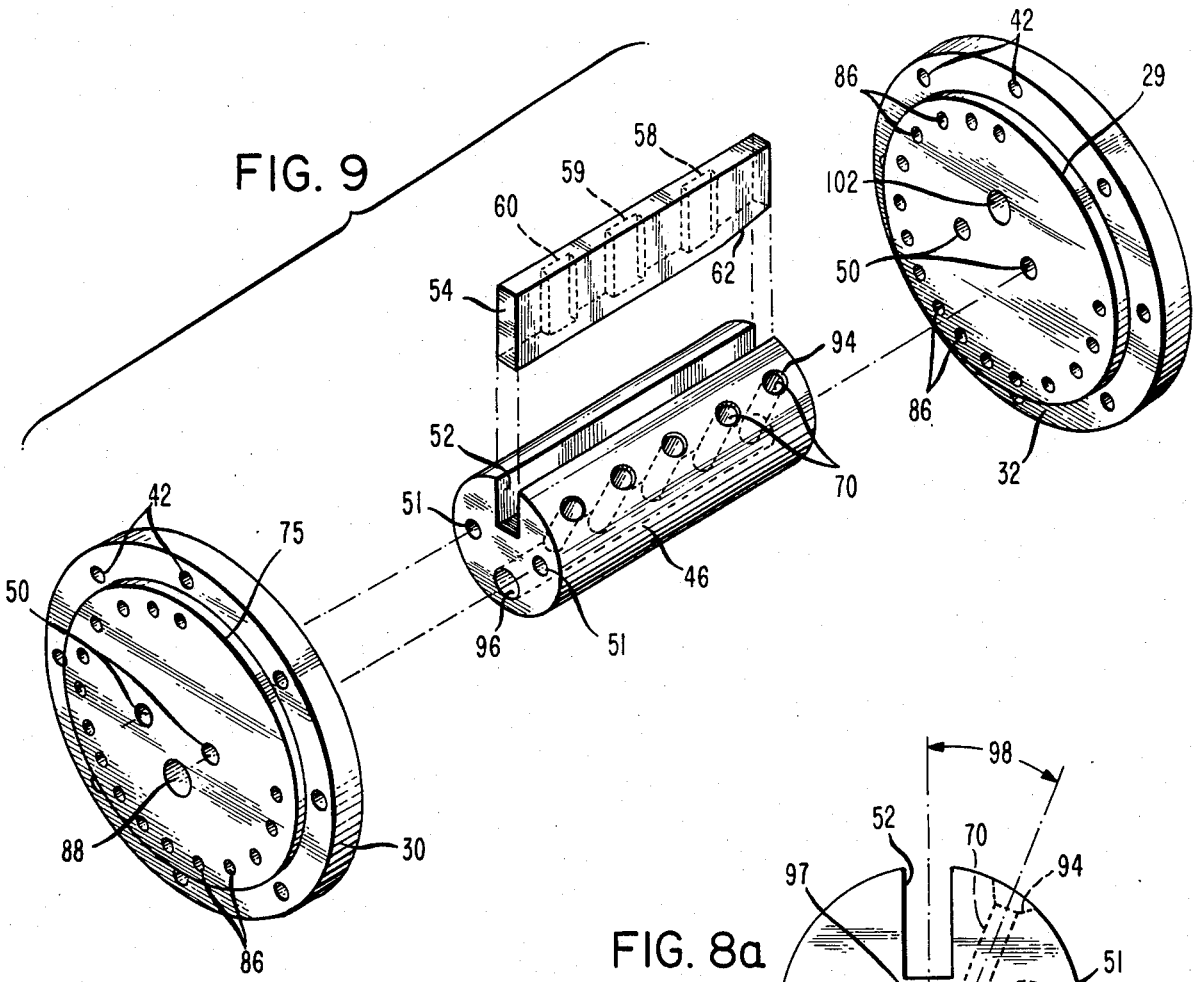
FIG. 9 represents a partly diagrammatic, isometric view and showing inner end plates as arranged in relationship with the fixed-in-place shaft.

In FIG. 9 there is shown an exploded isometric view which diagrammatically illustrates the very important relationship of the three-quarter diameter array of holes 86 provided in both end plates 30 and 32. Cap screws 48 and spring-type lock washers 49 when tightened maintain the desired alignment of these holes 86. Orientation and alignment to avoid one hundred eighty degrees out-of-phase only require that the longitudinally-drilled bole 96 in the shaft be in coincidence with hole 88 in plate 30 and that the nozzle aperture 102 in plate 32 be in way of the shaft slot 52.

Extensive tests have been run on this device and the results evaluated. It has been found very desirable to form the pattern of through apertures 86 very near or in coincidence with the inner diameter of the races 28. In FIG. 1, it is seen that the outer diameter of aperture 86 is in alignment with the inner diameter of the races 28. Moving the pattern of apertures 86 inwardly even a small distance reduces the speed of rotation of rotor 56 since the smaller the diameter of hole pattern the greater the number of through apertures blocked by the ends of this rotor 56 as it is revolved around the shaft 46. An increase in the size of the through exhaust apertures 86 tends to be counterproductive as this reduces back pressure and a slowing of rolling speed. Reduction in back pressure causes the rotor 56 to tend to begin a hitting mode of the roller against the races. Also, if you reduce the size of the through apertures, the speed of the rotor is reduced and finally, with too small an aperture, the unit is starved and does not function.

As shown in FIG. 1, the housing chamber is about four and one-quarter inches inner diameter and the inner diameter of the races 28 is about four and three-seconds of an inch. The pattern of apertures 86 is on a three and seven-eighths inch diameter. Preferably, the apertures are about three-sixteenths of an inch in diameter. Assuming about eighty pounds per square inch pressure on the air supplied to the vibrator, the number of apertures is from about fourteen to twenty-eight apertures in the three-quarter quadrant. If the pattern is reduced by about one-half inch on diameter, the speed is reduced about two thousand r.p.m. Although the pattern is preferred to be about three-quarter quadrant, this may be reduced to about two-thirds, but efficiency decreases as well as some speed.

ROTATIVE MOTION AS EXEMPLIFIED IN FIGS. 10A, 10B AND 10C

Figure 10A:
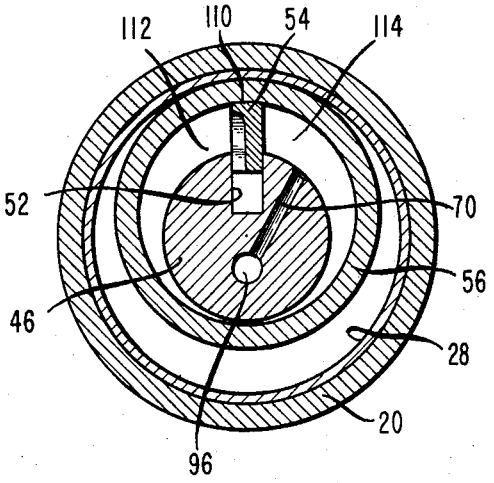
FIGS. 10A, 10B and 10C represent diagrammatic transverse sectional views showing the vibration apparatus in progressive positions of actuation.
Figure 10B:
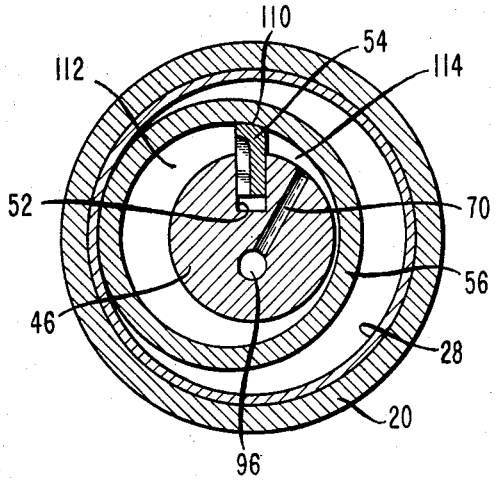

FIGS. 10A, B and C are diagrammatic stepwise progression representations of the rotative vibrations produced by this apparatus. Compressed air enters the vibrator interior through the conductor 66 and thence through nipple 64, and with the small sloped bottom 62 of the vane 54 this vane is moved upward in the slot 52 until the top surface 110, which is full width, comes in way of the inner diameter surface of the rotor 56. This causes the rotor to move toward the fixed shaft 46, but the races 28 prevent contact as these races are so constructed that the rotor is about one-sixty-fourth to one thirty-second of an inch from contact. This creates an air chamber 112 between the vane 54, the rotor 56 and shaft 46 as seen in FIG. 10A. The slots 58, 59 and 60 communicate with the slot 52 in shaft 46 and direct air as indicated by the arrow into this chamber. As the shaft 46 is spaced from and so as to not contact the rotor 56, air passes by the shaft 46 into a low-pressure chamber, identified as 114, which is the chamber on the other side of the vane 54 and is in flow communication with chamber 112.

It is to be noted that rotor 56 rolls on the races 28 rather than strikes the housing 20, and these races 28 insure that the rotor does not strike that shaft 46 at the inner end of its movement. Air flowing through the slots 58, 59 and 60 from the shaft slot 52 will increase the size of the chamber 112, forcing the rotor leftwardly and downwardly to the position represented by FIG. 10B. In this view, the chamber 114 has been drastically reduced in size and low-pressure air flows therefrom through the exhaust holes 70 in the shaft 46 and into longitudinal hole 96, thence through air passageway 88 into cover 39 and the muffler material 72 therein.

Figure 10C:
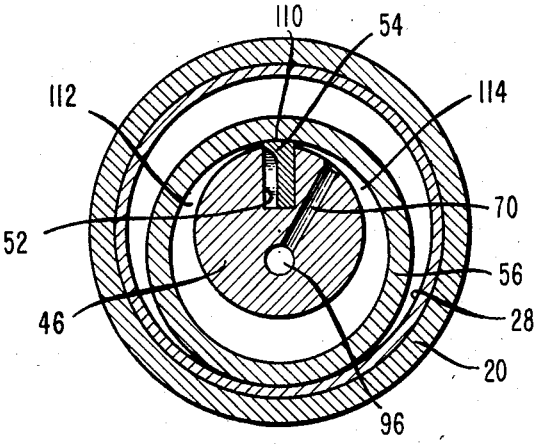

As more pressurized air is supplied to the chamber 112, the rotor 56 moves to the position of FIG. 10C, with the chamber 112 now expanded so that air in this chamber is in flow communication with the vent holes 70 in the shaft 46. It is to be noted that the vane 54 has moved inward in shaft slot 52 so that end 110 is within this slot and air is cut off from exiting or flowing from slots 58, 59 and 60. As soon as these slots 58, 59 and 60 are closed at their upper ends, high-pressure air begins to build up against the lower surface of the vane 54 and this vane is forced upwardly to the position depicted in FIG. 10A. The motion of the rotor is a combination of rotation and imparting eccentric force to produce vibrations by and with a steady flow and supply of pressurized air. These vibrations are from five thousand to more than ten thousand per minute. The vane 54 slides in the slot to correspond to every vibration. The wear plates 44 and 45 insure a close fit with this reciprocated vane and rotor.

The pattern of holes 86 in both of the inner end plates 30 and 31 is deliberately restricted so in the one-quarter quadrant absent holes the rotor-roller 56 does not move in a reciprocating pattern, but when the pattern of holes is void in one-quarter the roller is forced into a rolling motion or actuation. The pattern of holes is depicted as between twelve and three o'clock, but any quadrant may be utilized as long as the same position is utilized in both inner end plates.

EMBODIMENT OF FIG. 11

The embodiments above have shown a rotor or roller 56 as having regular inner and outer diameters. The vibrational force produced may be increased by making the roller heavier. The roller 56 of FIGS. 1 and 3 may be altered as shown to include two snap-ring grooves 116 and 117 and mounted in these grooves are like snap rings 118. A pressed-on additional tubular member 119 is shown mounted on rotor 56 and retained in spaced relationship by snap rings 118. The housing has to be altered to provide the additional clearance for this addition. The races 28 are still pressed in place to engage the outer diameter of roller 56. This additional weight provided by member 119 is a matter of selection.

CHART OF FIG. 12

Figure 12:
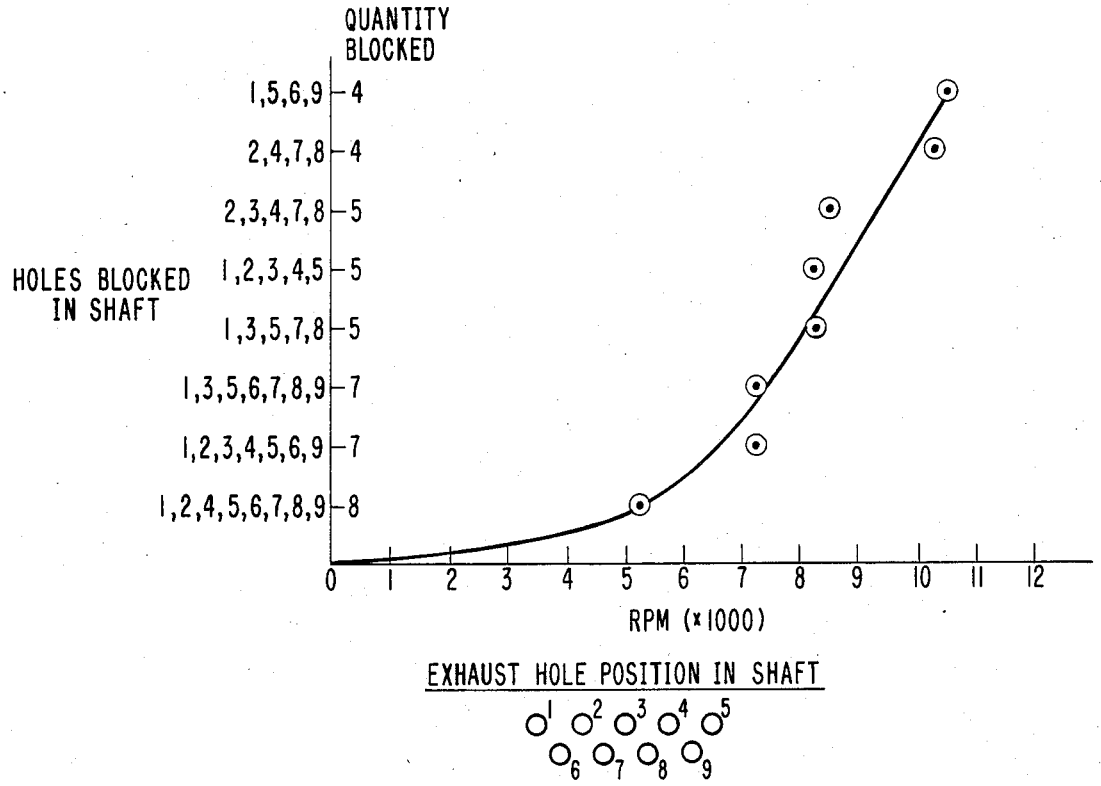
FIG. 12 represents a diagram to illustrate the selection of the preferred number of exhaust holes in the shaft.

Referring now to the chart of FIG. 12, it is to be noted that more or fewer exhaust holes 70 in shaft 46 have been evaluated. As many as nine holes were made and evaluated but, as noted in the chart, the best results were with five holes in the shaft. For this reason, five exhaust holes equally spaced, are provided in the shaft 46 described above.

Figure 6A:
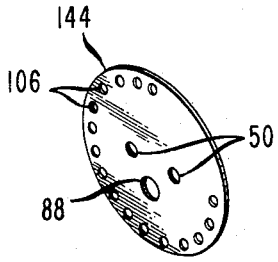
FIGS. 6A and 6B represent isometric views of alternate wear plates that have air transfer apertures through about three-quarters of a circular pattern.
Figure 6B:
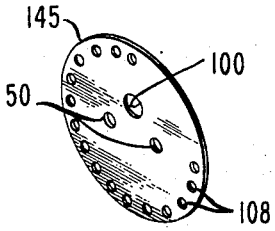

In the embodiments shown and described above, the wear plates 44 and 45, as seen in FIG. 3, and 144 and 145, as seen in FIGS. 6A and 6B, may be eliminated with the rotor 56 substantially in contact with the wear plates as it is moved. The wear plates are provided to allow simple replacement when worn and to prevent the need of replacement of expensive inner end plates 30 and 32.

USE AND OPERATION

The above shown and described air roller vibrator in many respects is very similar to the rotary vibrators known and used in industry for many years. The vibrator of this invention provides significant advances and advantages over prior devices in that the noise level is reduced to acceptable levels such as seventy-eight to eighty-two dB on the A-scale. Another significant improvement is the saving of pressurized air used with and for comparable vibrators. As noted above, the rotor 56 does not strike the races 28 in housing 20 as there is provided a three-quarter diametrical ring of air passage holes 86 in both the inner end plates 30 and 32. The exhaust air flowing in these passageways provides an air cushion that tends to lift the rotor 56 to a small degree. This flow of air across the backside or exterior of the rotor tends to make the rotor roll. This air flow provides the necessary cushion to prevent the rotor 56 from hitting the races 28. It is to be noted that the holes 86 are formed just at the race inner diameter. These races also insure that the rotor does not hit or strike the fixed-in-place shaft 46.

The design of the above-described vibrator is that instead of the rotor hitting the shaft five to twelve thousand times a minute, the rotor now slides on the hardened races and there is a slight clearance of about one sixty-fourth to one thirty-second of an inch between the ID of the rotor and the OD of the shaft, thus preventing the rotor from striking or hitting the shaft. To prevent reciprocation of the rotor, which is provided in the vibrators as noted in the prior art, the vibrator shown and described above changes not only the location but the size of the exhaust air canals. This air stream which passes along the outer diameter of the rotor not only prevents the rotor from hitting the races, but induces the desired rolling action. The muffler material 72 in the covers further reduces the noise levels to the desired levels established by OSHA.

By changing the rotor 56 from a striking or hitting action to a rolling actuation around and limited by the races 28, the vibration unit is much simpler since no compensation in design is required for hammer blow hitting and inch pounds of force created by the movement of the rotor. The centrifugal force now created is the same as in other devices, but is much less destructive. The resulting vibration apparatus is less expensive to manufacture, the noise level is reduced to acceptable levels and, if repairs are required because of abuse or unclean pressurized air, the down time and expense are reduced.

The unit above shown and described has only two moving components, the rotor 56 and the sliding vane 54. The fixed-in-place shaft 46 is held in oriented position between wear plates 44 and 45 and is secured by cap screws 48. Pressurized air enters through conductor 66 in an aperture 82 in cover 40 and exits from this cover plate through exhaust holes 84. This air enters through the conductor 66 and into slot 52 is shaft 46 to move vane 54 up and down. The exhaust grooves 58, 59 and 60 allow this pressurized air to flow into the high-pressure chamber 112 and around shaft 46 and from the low-pressure chamber side 114 to escape and flow through the holes 70 into the drilled passage 96 and thence through passageway 88 into the cavity in the back cover 39. This cover has no holes for the escape of air, but this air must and does flow through the plurality of holes 86 in inner plate 30. These holes are in three-quarters of a circle and as the rotor rolls around the races 28, these holes are alternately blocked and opened. These openings 86 are designed to create a back pressure with the diameter or size selected so that the exhausting air can only, under pressure, pass therethrough. This exhaust air, under pressure, provides a lifting force on the rotor 56 so that it is lifted or tends to be lifted and the swirl or the air tends to spin the rotor into a rolling action and prevents hitting the races 28. This spinning effect given the rotor is further promoted by having the exhaust holes 70 in the shaft so positioned with reference to the vane so that the vane does not fully extend out to its outward position before the air exhausts through holes 70 (FIG. 10A). The vane is pushed back into slot 52 (starting position FIG. 10C) to start the cycle again. This further promotes the rolling motion of the rotor 56.

In FIG. 9, the relationship of those exhaust holes 86 formed in inner end plate 30 and the like pattern of holes 86 formed in the front inner plate 32 are depicted. The three-quarters circle of holes (0° to 270°) and the one-quarter circle (90°) remaining absent exhaust holes are positioned so as to be more or less in line with the line of exhaust inlet holes 70 in shaft 46. This absence of exhaust holes is such that there is no pressure from the exhausting air exerted on the roller or rotor 56 during this quarter of a circle area. This further produces a tendency to promote the spinning or rotating action on the rotor. The air as it passes over the rotating rotor 56 in the cavity between housing 20 and rotor 56 and wear plates 44 and 45 passes through the holes 86 in inner end plate 32, thence through the muffler material 72, through the exhaust holes 84 to the atmosphere.

This rotary air roller vibrator design, as above shown and described, proves an air saving benefit. This unit immediately starts as soon as the valve is cracked, releasing pressurized air. What actually happens is that the exhaust holes 70 in the shaft shut off escaping air before air in the unit reaches atmospheric pressure. Contrary to prior vibrator devices using a tubular rotor in which, to operate satisfactorily, the interior must be brought to atmospheric pressure, the vibrator of this invention does not require such a reduction, thus providing a saving on in-rushing air since the build-up does not have to start at atmospheric pressure but from a pressure higher than atmospheric pressure to operating pressure. The higher the operating pressure, the greater the savings in pressurized air consumption. The immediate start of the vibrator of this invention is also related to the exhaust holes 70 since in and at the starting moment the rotor only has to close the shaft exhaust holes 70 to get started. As the vibrations increase, the rotor is lifted away from the shaft, with the exhaust force creating the rolling motion of the rotor and the vibration force of the moving and rolling rotor.

Terms such as "left," "right," "up," "down," "bottom," "top," "front," "back," "in," "out" and the like are applicable to the embodiments shown and described in conjunction with the drawings. These terms are merely for the purposes of description and do not necessarily apply to the position in which the rotary air roller vibrator may be constructed or used.

While a particular embodiment of the air roller vibrator and alternate embodiments have been shown and described, it is to be understood that the invention is not limited thereto and protection is sought to the broadest extent the prior art allows.

What is claimed is:

1. A rotary air roller vibrator having two moving members and driven by pressurized air brought to the vibrator, producing centrifugal vibratory forces at selected speeds in the operation thereof at acceptable OSHA noise levels, this vibrator including:

(a) a housing having a cylindrical interior bore with and of a determined inner diameter;

(b) first and second substantially like inner end plates aligned and detachably secured to the housing to form a tubular interior chamber, each end plate having at least a two-thirds quadrant and circle of a multiplicity of through apertures adjacent the outer diameter of the cylindrical chamber, these through apertures when these end plates are detachably secured to the housing being in alignment, said remaining quadrant of the circle absent apertures;

(c) a pair of like-sized tubular races, with one of each said races secured in formed counterbores in each of the ends of the housing, and with these races interior of and adjacent each inner end plate;

(d) a shaft having a selected exterior diameter, this shaft mounted axially in the housing and contained wholly between said end plates, and means for securing said shaft to said end plates to prevent relative rotation thereof;

(d) a slot formed lengthwise of the shaft and radially disposed and extending the full length of said shaft;

(e) an inlet hole in the first end plate and in flow communication with the lower portion of said slot in the shaft;

(f) an exhaust bore completely through said shaft and below said slot and longitudinally thereof, this bore communicating with an exhaust air passageway formed in the second end plate;

(g) a multiplicity of transverse exhaust holes formed in said shaft and having the inner ends of said holes in flow communication and terminating in and with said exhaust bore in the shaft, these exhaust holes providing entrance ports arrayed in a longitudinal line on the circumferential surface of said shaft, and with the shaft in a retained condition this longitudinal line of ports is in alignment with that quadrant provided in end plates and absent of through apertures;

(h) a vane mounted in said slot in the shaft, this vane radially reciprocably moved in said slot by and with influent pressurized air, said vane having at least three air supply slot openings formed in the side wall and bottom edge thereof, each of said supply slots being substantially closed when the vane is at its inner position, this vane positioned in the slot in the shaft so that the air supply slots are disposed opposite the port entrances of the row of transverse exhaust holes formed in said shaft;

(i) a cylindrical rotor having an inner diameter greater than the diameter of the shaft and an outer diameter less than the diameter of the cylindrical bore of the housing, the outer diameter of the rotor as and when it contacts the races being of such a size that the inner diameter of the rotor does not contact the outer diameter of the shaft, said rotor having the ends finished and this rotor of a length so that the ends are slideable within the end plates and the end surfaces of the rotor come in way of the array of apertures and substantially progressively block a few apertures as the rotor is moved in an orbital path;

(j) a rear cover secured to the housing and providing a cavity exterior of the second end plate, said cavity disposed to receive and retain the exhaust air from the cylindrical bore in the housing and interior of the rotor, this rear cover containing muffler material to assist in reducing noise of the use of the vibrator, this cover cavity open to the quadrant pattern of apertures in the second end plate;

(k) a front cover secured to the housing and providing a cavity exterior of the first end plate, said cavity disposed to receive and guide exhaust air from the cylindrical housing and exterior of the rotor and direct this air through muffler material to and through a multiplicity of vent holes formed in said front cover, and (l) an inlet conductor for pressurized air, this conductor disposed to carry said air to and through the inlet hole formed in said first end plate whereby, upon application of pressurized air through the air conductor, this air enters the slot in the shaft and the vane therein is urged outwardly and said rotor is lifted and forced to move about said shaft to provide an unbalanced condition, and that pressurized air exiting from the slots in the vane directing pressurized air at an angle and against the inner diameter of the rotor, tending to spin said rotor, and the quadrant apertures providing a flow path and cushioning force on the outer surface of the rotor, tending to lift the rotor and inducing rotation while the rotor travels in a circular pattern, the quadrant pattern of through apertures in the end plates inducing a quick start-up and saving of pressurized air since the inner bore does not need to come to atmospheric pressure every cycle.

2. A rotary air roller vibrator as in claim 1 in which there are additionally provided two thin wear plates and when secured to be positioned adjacent to and contiguous with the inner faces of said first and second inner end plates, the first wear plate formed with an inlet hole that is sized and positioned to be in coincidence with the inlet hole in the first end plate and the second wear plate formed with an exhaust hole that is sized and positioned to be in coincidence with the exhaust air passageway formed in the second end plate.

3. A rotary air roller vibrator as in claim 2 in which the first and second wear plates are made of a sufficient diameter to extend to at least the outer diameter extent of the housing cylindrical bore and in each wear plate there is formed a multiplicity of through apertures that are sized, positioned and formed to be in coincidence with the multiplicity of through apertures formed in and provided in the first and second inner end plates.

4. A rotary air roller vibrator as in claim 2 in which said tubular rotor slideably and sealingly engages the wear plates at opposite ends of said rotor.

5. A rotary air roller vibrator as in claim 1 in which the vane is made of plastic and is adapted to slideably and sealingly engage the inner diameter portion of said rotor.

6. A rotary air roller vibrator as in claim 5 in which the vane is made with the three side slots terminating at a deflecting end about one-sixteenth from the top or outward surface portion, and this top portion is substantially full width of the slot in the shaft, the side slots in said vane so spaced that pressurized air entering the bottom portion of the slot in the shaft engages the bottom of said vane tending to lift said vane upwardly or outwardly, the spacing of these side slots in the vane causing an equalizing of the lift pressure on the vane and that said upward lifting pressure does not produce a cocking of the vane.

7. A rotary air vibrator as in claim 6 in which the deflecting ends of the side slots in the vane are arcuate.

8. A rotary air vibrator as in claim 7 in which the bottom surface of the vane is formed with a slope or bevel decreasing from the pressurized air entrance end to at least the first side slot where said slope ends at the bottom surface of the vane.

9. A rotary air vibrator as in claim 8 in which the slope is from three to five degrees to the bottom surface of the vane.

10. A rotary air vibrator as in claim 1 in which the clearance of the rotor inside diameter and the outer diameter of the shaft is between one sixty-fourth and three sixty-fourths of an inch.

11. A rotary air vibrator as in claim 1 in which the angle of the axis of the exhaust holes in the shaft and a line through the axis of the exhaust bore and the centerline of the slot for the vane slideable in the shaft are from twenty to thirty degrees.

12. A rotary air vibrator as in claim 1 in which the number of exhaust holes formed in the shaft is at least four and less than seven.

13. A rotary air vibrator as in claim 12 in which the number of exhaust holes formed in the shaft is five.

14. A rotary air vibrator as in claim 1 in which said cylindrical rotor has an added tubular member retained on the outer diameter of said cylindrical rotor so as to provide an added weight, space for this added tubular member being accommodated by forming the housing with an increased inner diameter bore, the races still providing limits of outward movement of the rotor so that the inner diameter of said rotor and the added tubular member does not change the clearance between the rotor and shaft.

15. A rotary air vibrator as in claim 1 in which each of the rear and front covers is formed with central cup-shaped recesses and the outer rim portions of said covers are formed with seating shoulders and with securing means that includes bolt apertures spaced and sized to accept through cap screws which pass through said apertures and into threaded holes formed in the housing.

16. A rotary air vibrator as in claim 15 in which the rear and front covers are also formed with spaced recesses adapted to allow cap screws to be passed through holes formed in the first and second end plates and secure said end plates to the housing and excluding the securing of rear and front covers by other cap screws.

17. A rotary air vibrator as in claim 1 in which the inlet conductor includes a nipple member secured in said first end plate, this nipple adapted to receive and by clamp means retain a flexible pressurized air conductor having a length portion which is exterior of the rotary air vibrator.

18. A rotary air vibrator as in claim 1 in which the number of through apertures in each end plate is not less than twelve and not more than twenty-eight and the diameter of each aperture is about three-sixteenths of an inch.

19. A rotary air vibrator as in claim 1 in which the housing ends, the first and second inner end plates and the flange portions of the rear and front covers are formed with male and female shoulders adapted to provide positive and concentric alignment as to a common longitudinal axis through the secured shaft.

20. A rotary air roller vibrator having two moving members and in use and driven by pressurized air brought to the vibrator, producing vibration forces at selected speeds in the operation thereof at acceptable OSHA noise levels, this vibrator including:

(a) a housing having a cylindrical interior bore with and of a determined inner diameter;

(b) first and second substantially like inner end plates aligned and detachably secured to the housing to form a tubular interior chamber, each end plate having a three-quarter circle of a multiplicity of through exhaust apertures adjacent the outer diameter of the tubular chamber, these through exhaust apertures when these end plates are detachably secured to the housing being in alignment, each end plate having one-quarter circle remaining absent exhaust apertures;

(c) like wear plates of sheet steel less than three thirty-secondths of an inch in thickness and secured so as to be contiguous with the inward-facing surfaces of each of the inner end plates;

(d) a pair of like-sized tubular races, with one of each said races secured in formed counterbores in each of the ends of the housing, and with these races interior of and adjacent each inner end plate;

(e) a shaft having a selected exterior diameter, this shaft mounted axially of each end of the housing and contained wholly between said wear and end plates, with means for securing said shaft to said end plates to prevent relative rotation thereof;

(f) a slot formed lengthwise of the shaft and radially disposed and extending the full length of said shaft;

(g) an inlet hole in the first end plate and in flow communication with the lower portion of said slot in the shaft;

(h) an exhaust bore in said shaft and below said slot and longitudinally thereof, this bore communicating with an exhaust air passageway formed in the second end plate;

(i) a multiplicity of transverse exhaust holes formed in said shaft and having the inner ends of said holes in flow communication and terminating in and with said exhaust bore in the shaft, these exhaust holes providing entrance ports arrayed in a longitudinal line on the circumferential surface of said shaft, and with the shaft in a retained condition this longitudinal line of ports is in alignment with that quarter of end plates absent exhaust apertures;

(j) a vane mounted in said slot in the shaft, this vane radially reciprocably moved in said slot by and with influent pressurized air, said vane having at least three air supply slot openings formed in the side wall and bottom edge thereof, each of said supply slots being substantially closed when the vane is at its inner position, this vane positioned in the slot in the shaft so that the air supply slots are disposed opposite the port entrances of the row of transverse exhaust holes formed in said shaft;

(k) a cylindrical rotor having an inner diameter greater than the diameter of the shaft and an outer diameter less than the diameter of the cylindrical bore of the housing, the outer diameter of the rotor as and when it contacts the races being of a size that the inner diameter does not contact the outer diameter of the shaft, said rotor having the ends finished and normal to the longitudinal axis of the rotor and this rotor of a length so that the ends are slideable within the wear plates and the end surfaces of the rotor come in way of the array of apertures and substantially progressively block a few apertures as the rotor is moved in an orbital path;

(l) a rear cover secured to the housing and providing a cavity exterior of the second end plates, said cavity disposed to receive and retain the exhaust air from the cylindrical bore in the housing and interior of the rotor, this rear cover containing muffler material to assist in reducing noise of the use of the vibrator, this cover cavity open to the three-quarter pattern of apertures in the second end plate;

(m) a front cover secured to the housing and providing a cavity exterior of the first end plate, said cavity disposed to receive and guide exhaust air from the cylindrical housing and exterior of the rotor and direct this air through muffler material to and through a multiplicity of vent holes formed in said front cover, and (n) an inlet conductor for pressurized air, this conductor disposed to carry said air to and through the inlet hole formed in said first end plate and wear plate whereby, upon application of pressurized air through the air conductor, this air enters the slot in the shaft and the vane therein is urged outwardly and said rotor is lifted and forced to move about said shaft to provide an unbalanced condition, and that pressurized air exiting from the slots in the vane direction pressurized air at an angle and against the inner diameter of the rotor, tending to spin said rotor, and the three-quarter apertures providing a flow path and cushioning force on the outer surface of the rotor, tending to lift the rotor and inducing rotation while the rotor travels in a circular pattern, the three-quarter pattern of through apertures in the end plates inducing a quick start-up and saving of pressurized air since the inner bore does not need to come to atmospheric pressure every cycle.

* * * * *